US012161149B2

(12) United States Patent
Kim et al.

(10) Patent No.: US 12,161,149 B2
(45) Date of Patent: Dec. 10, 2024

(54) WRAPPER FOR NON-COMBUSTIBLE CIGARETTE AND METHOD FOR MANUFACTURING SAME

(71) Applicant: KT&G CORPORATION, Daejeon (KR)

(72) Inventors: Soo Ho Kim, Cheongju-si (KR); Ki Jin Ahn, Daejeon (KR); Young Rim Han, Daejeon (KR); Jong Yeol Kim, Sejong (KR); Chang Jin Park, Sejong (KR)

(73) Assignee: KT&G CORPORATION, Daejeon (KR)

( * ) Notice: Subject to any disclaimer, the term of this patent is extended or adjusted under 35 U.S.C. 154(b) by 649 days.

(21) Appl. No.: 17/421,206

(22) PCT Filed: Mar. 22, 2021

(86) PCT No.: PCT/KR2021/003501
§ 371 (c)(1),
(2) Date: Jul. 7, 2021

(87) PCT Pub. No.: WO2021/230488
PCT Pub. Date: Nov. 18, 2021

(65) Prior Publication Data

US 2022/0256906 A1 Aug. 18, 2022

(30) Foreign Application Priority Data

May 11, 2020 (KR) ..... 10-2020-0056158

(51) Int. Cl.
*A24B 3/14* (2006.01)
*A24B 15/12* (2006.01)
(Continued)

(52) U.S. Cl.
CPC ..... *A24B 3/14* (2013.01); *A24B 15/12* (2013.01); *A24B 15/282* (2013.01); *A24C 5/005* (2013.01); *A24C 5/01* (2020.01); *A24D 1/02* (2013.01)

(58) Field of Classification Search
None
See application file for complete search history.

(56) References Cited

U.S. PATENT DOCUMENTS 4,225,636 A 9/1980 Cline et al.
4,306,578 A 12/1981 Schmidt et al.
(Continued)

FOREIGN PATENT DOCUMENTS

CN 103211287 A 7/2013
CN 104939294 A 9/2015
(Continued)

OTHER PUBLICATIONS

WO 2019211890 A1 English translation, obtained from Espacenet, pp. 1-14 (Year: 2019).*
(Continued)

*Primary Examiner* — Philip Y Louie
*Assistant Examiner* — Madeleine P Delacruz
(74) *Attorney, Agent, or Firm* — Sughrue Mion, PLLC

(57) ABSTRACT

A method of manufacturing a wrapper for a non-combustion-type cigarette used in an aerosol generating device, according to an embodiment, includes manufacturing a reconstituted tobacco sheet by mixing a tobacco material and first pulp, and manufacturing a wrapper by mixing the reconstituted tobacco sheet and second pulp. A wrapper for a non-combustion-type cigarette used in an aerosol generating device has a tensile strength of 3.0 kgf/15 mm or greater, and includes at least one of cigar leaf powder, cigar leaf pieces, and cigar leaves.

3 Claims, 4 Drawing Sheets

(51) Int. Cl.

| | |
|---|---|
| ***A24B 15/28*** | (2006.01) |
| ***A24C 5/00*** | (2020.01) |
| ***A24C 5/01*** | (2020.01) |
| ***A24D 1/02*** | (2006.01) |
| ***A24D 1/20*** | (2020.01) |
| ***A24F 40/20*** | (2020.01) |
| ***D21H 11/04*** | (2006.01) |
| ***D21H 17/02*** | (2006.01) |
| ***D21H 27/10*** | (2006.01) |

(56) References Cited

U.S. PATENT DOCUMENTS

| | | | | | |
|---|---|---|---|---|---|
| 4,421,126 | A | * | 12/1983 | Gellatly | A24B 15/12 131/374 |
| 4,938,238 | A | | 7/1990 | Barnes et al. | |
| 5,065,776 | A | | 11/1991 | Lawson et al. | |
| 5,105,837 | A | | 4/1992 | Barnes et al. | |
| 5,284,166 | A | | 2/1994 | Cartwright et al. | |
| 5,322,076 | A | | 6/1994 | Brinkley et al. | |
| 6,676,806 | B1 | | 1/2004 | Butt, Sr. | |
| 9,289,013 | B2 | | 3/2016 | Taniguchi et al. | |
| 10,575,553 | B2 | | 3/2020 | Minzoni | |
| 11,202,467 | B2 | | 12/2021 | Malgat | |
| 2003/0178039 | A1 | | 9/2003 | White et al. | |
| 2005/0056294 | A1 | | 3/2005 | Wanna et al. | |
| 2008/0006286 | A1 | | 1/2008 | Mua et al. | |
| 2011/0168195 | A1 | | 7/2011 | Oliveira | |
| 2015/0107611 | A1 | | 4/2015 | Metrangolo et al. | |
| 2016/0213063 | A1 | | 7/2016 | Ajithkumar et al. | |
| 2018/0007973 | A1 | | 1/2018 | Thorens | |
| 2018/0125113 | A1 | | 5/2018 | Minzoni | |
| 2019/0269169 | A1 | | 9/2019 | Malgat | |
| 2019/0373948 | A1 | | 12/2019 | Zhao | |
| 2020/0048839 | A1 | | 2/2020 | Oishi et al. | |
| 2020/0323260 | A1 | | 10/2020 | Osawa et al. | |
| 2021/0092989 | A1 | | 4/2021 | Han et al. | |

FOREIGN PATENT DOCUMENTS

| | | | | | |
|---|---|---|---|---|---|
| CN | 105077555 | A | | 11/2015 | |
| CN | 109496128 | A | | 3/2019 | |
| CN | 110574957 | A | * | 12/2019 | A24B 3/14 |
| JP | 9-47272 | A | | 2/1997 | |
| JP | 11-59694 | A | | 3/1999 | |
| JP | 2011-525368 | A | | 9/2011 | |
| JP | 2012-6175 | A | | 1/2012 | |
| JP | 2018-145585 | A | | 9/2018 | |
| JP | 2019-525725 | A | | 9/2019 | |
| JP | 2019-526251 | A | | 9/2019 | |
| JP | 2019-187451 | A | | 10/2019 | |
| KR | 10-2007-0035613 | A | | 3/2007 | |
| KR | 10-2015-0004433 | A | | 1/2015 | |
| KR | 10-1534822 | B1 | | 7/2015 | |
| KR | 10-2020-0018354 | A | | 2/2020 | |
| RU | 2 700 946 | C2 | | 9/2019 | |
| WO | WO-2015035137 | A1 | * | 3/2015 | A24C 5/005 |
| WO | 2019/101623 | A1 | | 5/2019 | |
| WO | 2019/130445 | A1 | | 7/2019 | |
| WO | WO-2019211890 | A1 | * | 11/2019 | A24B 15/12 |
| WO | WO-2020105930 | A1 | * | 5/2020 | A24C 5/005 |

OTHER PUBLICATIONS

CN 110574957 A English translation obtained from Espacenet, pp. 1-12 (Year: 2019).*

WO2020105930A1 English Translation obtained from Espacenet, pp. 1-5 (Year: 2020).*

Supplementary European Search Report issued Feb. 18, 2022 in European Application No. 21739895.7.

Communication dated Apr. 6, 2023, issued in Chinese Application No. 202180006511.2.

Communication dated Mar. 28, 2023, issued in Japanese Application No. 2021-532130.

Communication dated May 17, 2023, issued in Russian Application No. 2022112014/03.

Notification of Reasons for Refusal dated Sep. 20, 2022, from the Japan Patent Office in application No. 2021-532130.

International Search Report for PCT/KR2021/003501 dated Jun. 28, 2021 [PCT/ISA/210].

Written Opinion for PCT/KR2021/003501 dated Jun. 28, 2021 [PCT/ISA/237].

Chinese Office Action issued Jan. 23, 2024 in Application No. 202180006511.2.

Japanese Office Action issued Feb. 20, 2024 in Application No. 2021-532130.

* cited by examiner

WRAPPER FOR NON-COMBUSTIBLE CIGARETTE AND METHOD FOR MANUFACTURING SAME

TECHNICAL FIELD

The present disclosure relates to a wrapper for wrapping a non-combustion-type cigarette used in an aerosol generating device, and a method of manufacturing the same.

BACKGROUND ART

Recently, the demand for alternative methods to overcome the disadvantages of traditional cigarettes has increased. For example, there is growing demand for an aerosol generating device which generates aerosol by heating an aerosol generating material, rather than by combusting cigarettes.

A wrapper used for a combustion-type-cigarette has a low basis weight and high porosity, and includes a combustion improver and a filler for combustion, thus being unsuitable for a non-combustion-type cigarette used in an aerosol generating device.

DESCRIPTION OF EMBODIMENTS

Technical Problem

Provided are a wrapper for a non-combustion type cigarette used in an aerosol generating device and a method of manufacturing the same.

The technical problems are not limited thereto, and other technical problems may be derived from the following examples.

Solution to Problem

A method of manufacturing a wrapper for a non-combustion type cigarette used in an aerosol generating device according to an embodiment includes: manufacturing a reconstituted tobacco sheet by mixing a tobacco material and first pulp; and manufacturing a wrapper by mixing the reconstituted tobacco sheet and second pulp.

Advantageous Effects of Disclosure

As a tobacco material forms a pattern on a wrapper, a cigarette with visual distinctiveness may be provided.

By manufacturing the wrapper by using non-washed pulp, a cigarette with visual distinctiveness may be provided, and a high tensile strength of the wrapper may be achieved.

Advantageous effects of the disclosure are not limited thereto, and various other effects are included in the present specification.

BEST MODE

A method of manufacturing a wrapper for a non-combustion type cigarette used in an aerosol generating device includes: manufacturing a reconstituted tobacco sheet by mixing a tobacco material and first pulp; and manufacturing a wrapper by mixing the reconstituted tobacco sheet and second pulp.

The manufacturing of the reconstituted tobacco sheet includes: preparing the reconstituted tobacco sheet by mixing at least any one of cigar leaf powder, cigar leaf pieces, cigar leaves, and tobacco leaves, as the tobacco material, and the first pulp.

The manufacturing of the reconstituted tobacco sheet includes manufacturing the reconstituted tobacco sheet by mixing the tobacco material and at least one of unbleached kraft pulp and bleached kraft pulp as the first pulp.

The manufacturing of the wrapper includes manufacturing the wrapper by mixing the reconstituted tobacco sheet and at least any one of the unbleached kraft pulp and the bleached kraft pulp as the second pulp.

The manufacturing of the wrapper includes: manufacturing a uncoated wrapper by mixing the reconstituted tobacco sheet and the second pulp; and manufacturing a coated wrapper by coating the uncoated wrapper.

The wrapper for a non-combustion type cigarette used in an aerosol generating device according to an embodiment has a tensile strength of 3.0 kgf/15 mm or greater, and includes at least any one of cigar leaf powder, cigar leaf pieces, cigar leaves, and tobacco leaves.

The wrapper includes the unbleached kraft pulp.

MODE OF DISCLOSURE

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 1:
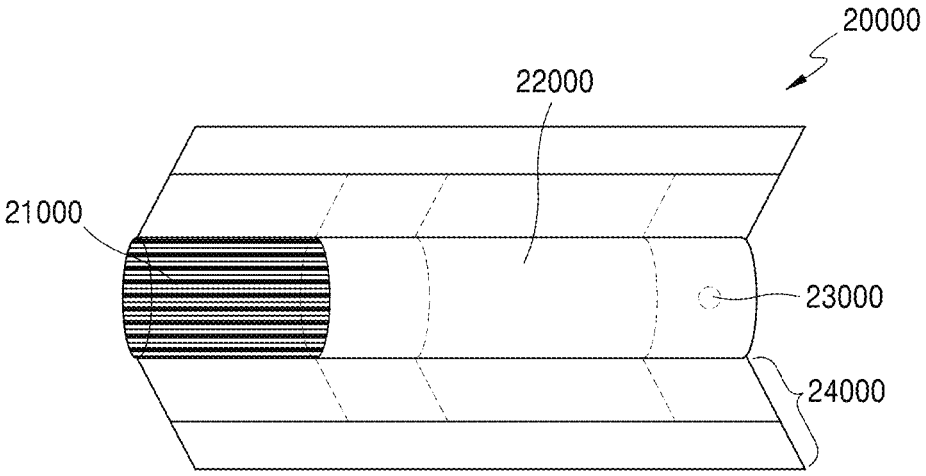
FIG. 1 is a diagram of a cigarette according to an embodiment.

FIG. 1 is a diagram of a cigarette according to an embodiment.

A cigarette 20000 is a non-combustion type cigarette to be used in an aerosol generating device. The cigarette 20000 includes a tobacco rod 21000 and a filter rod 22000. FIG. 1 illustrates that the filter rod 22000 includes a single segment. However, the filter rod 22000 is not limited thereto. In other words, the filter rod 22000 may include a plurality of segments. For example, the filter rod 22000 may include a first segment configured to cool an aerosol and a second segment configured to filter a certain component included in the aerosol. Also, as necessity, the filter rod 22000 may further include at least one segment configured to perform other functions.

The cigarette 20000 may be packaged by at least one wrapper 24000. The wrapper 24000 may have at least one hole through which external air may be introduced or internal air may be discharged. For example, the cigarette 20000 may be packaged by the wrapper 24000. As another example, the cigarette 20000 may be doubly packaged by two or more wrappers 24000. For example, the tobacco rod 21000 may be packaged by a first wrapper, and the filter rod 22000 may be packaged by a second wrapper. Also, the tobacco rod 21000 and the filter rod 22000, which are respectively packaged by separate wrappers, may be coupled to each other, and the cigarette 20000 may be packaged by a third wrapper. When each of the tobacco rod 21000 and the filter rod 22000 includes a plurality of segments, each segment may be packaged by a separate wrapper. Also, the cigarette 20000 including the plurality of segments, which are respectively packaged by the separate wrappers and which are coupled to each other, may be re-packaged by another wrapper.

The tobacco rod 21000 may include an aerosol-generating material. For example, the aerosol-generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21000 may include other additives, such as flavors, a wetting agent, and/or organic acid. Also, the tobacco rod 21000 may include a flavoring liquid, such as menthol or a moisturizer, which is injected to the tobacco rod 21000.

The tobacco rod 21000 may be manufactured in various forms. For example, the tobacco rod 21000 may be formed as a sheet or a strand. Also, the tobacco rod 21000 may be formed as a pipe tobacco, which is formed of tiny bits cut from a tobacco sheet. Also, the tobacco rod 21000 may be surrounded by a heat conductive material. For example, the heat conductive material may be, but is not limited to, a metal foil such as aluminum foil. For example, the heat conductive material surrounding the tobacco rod 21000 may uniformly distribute heat transmitted to the tobacco rod 21000, and thus, the heat conductivity applied to the tobacco rod may be increased and taste of a tobacco may be improved. Also, the heat conductive material surrounding the tobacco rod 21000 may function as a susceptor heated by an induction heater. Here, although not illustrated in the drawings, the tobacco rod 21000 may further include an additional susceptor, in addition to the heat conductive material surrounding the tobacco rod 21000.

The filter rod 22000 may include a cellulose acetate filter. Shapes of the filter rod 22000 are not limited. For example, the filter rod 22000 may include a cylinder-type rod or a tube-type rod having a hollow inside. Also, the filter rod 22000 may include a recess-type rod. When the filter rod 22000 includes a plurality of segments, at least one of the plurality of segments may have a different shape.

The filter rod 22000 may be formed to generate flavors. For example, a flavoring liquid may be injected onto the filter rod 22000, or an additional fiber coated with a flavoring liquid may be inserted into the filter rod 22000.

Also, the filter rod 22000 may include at least one capsule 23000. Here, the capsule 23000 may generate a flavor or an aerosol. For example, the capsule 23000 may have a configuration in which a liquid containing a flavoring material is wrapped with a film. For example, the capsule 23000 may have a spherical or cylindrical shape, but is not limited thereto.

When the filter rod 22000 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

Although not shown in FIG. 1, the cigarette 20000 according to an embodiment may further include a front-end filter. The front-end filter may be located on a side of the tobacco rod 21000 which is opposite to the filter rod 22000. The front-end filter may prevent the tobacco rod 21000 from being detached outwards and prevent a liquefied aerosol from flowing into the aerosol generating device from the tobacco rod 21000, during smoking.

Figure 2:
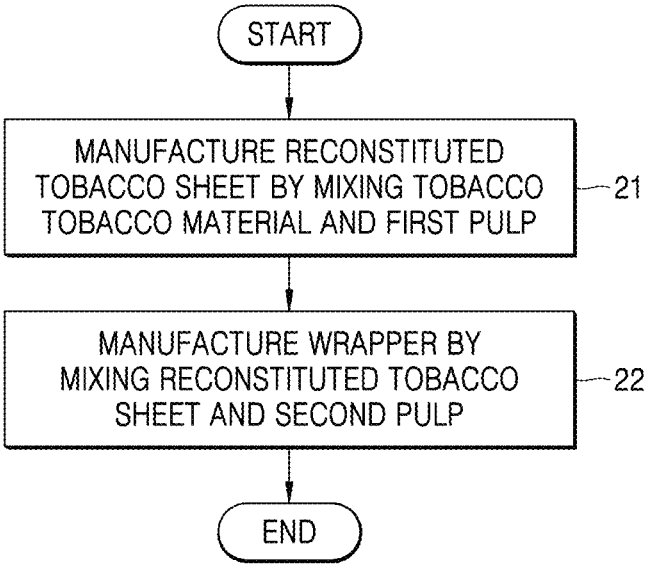
FIG. 2 is a flowchart of a method of manufacturing a wrapper according to an embodiment.

FIG. 2 is a flowchart of a method of manufacturing a wrapper according to an embodiment.

FIG. 2 shows a manufacturing method of a wrapper for packaging a non-combustion type cigarette used in the aerosol generating device.

In an embodiment, a wrapper may include a wrapper to be used as a last outer cover of the cigarette. On the contrary, the wrapper may also include a wrapper to be used as an inner cover of the cigarette.

In operation 21, a reconstituted tobacco sheet is manufactured by mixing a tobacco material and first pulp.

In an embodiment, the reconstituted tobacco sheet may be manufactured by performing mixed refining on the tobacco material and the first pulp. In an embodiment, a drafting paper process may be used to manufacture the reconstituted tobacco sheet. For example, a drafting paper process using a fourdrinier wire may be used to manufacture the reconstituted tobacco sheet. In addition, a cylinder-type drafting paper process may be used to manufacture the reconstitute sheet.

The tobacco material includes at least one of cigar leaf powder, cigar leaf pieces, cigar leaves, and tobacco leaves.

In an embodiment, the tobacco material includes cigar leaf powder. Cigar leaves are tobacco leaves used for manufacturing a cigarette. The tobacco leaves may include flue-cured, burley, native, cigar, or orient, but is not limited thereto. In other embodiments, the tobacco material may include cigar leaf pieces or cigar leaf powder. Cigar leaf pieces or cigar leaf powder may be obtained by segmenting or grinding the cigar leaf. Alternatively, the cigar leaf pieces and the cigar leaf powder may be obtained from a by-product that is generated while the tobacco leaves are processed.

First pulp includes at least one of unbleached kraft pulp (UKP) and bleached kraft pulp (BKP).

In an embodiment, the first pulp includes UKP. By using the UKP, a tensile strength of a finally produced wrapper may be improved. In addition, the finally produced wrapper is colored due to the UKP, and therefore, a cigarette with visual distinctiveness may be provided. In another embodiment, the first pulp may include the BKP.

The reconstituted tobacco sheet may be manufactured by mixing and drying the tobacco material and the first pulp. A weight ratio between the tobacco material and the first pulp may be set in consideration of a color, a pattern, a tensile strength and the like of the finally produced wrapper. For example, the reconstituted tobacco sheet may be manufactured by mixing the cigar leaf powder and the UKP in a weight ratio of 90:10. As another example, the reconstituted tobacco sheet may be manufactured by mixing the cigar leaf powder and the UKP in a weight ratio of 10:90.

Table 1 shows a result of analyzing the quality of the cigar leaf powder, Table 2 shows a result of analyzing the quality of the reconstituted tobacco sheet, and Table 3 shows decrease ratios of components in Table 2 compared to components in Table 1.

TABLE 1

| number of times of analysis | HWS (wt %) | nicotine (wt %) | total sugar (wt %) | $NO_3$ (wt %) | Cl (wt %) |
|---|---|---|---|---|---|
| 1 | 39.4 | 0.93 | 0.78 | 0.90 | 0.29 |
| 2 | 39.5 | 0.98 | 0.76 | 0.94 | 0.26 |
| 3 | 38.3 | 0.97 | 0.74 | 0.93 | 0.26 |
| 4 | 40.8 | 0.97 | 0.80 | 0.99 | 0.35 |
| 5 | 40.0 | 0.97 | 0.77 | 1.03 | 0.28 |
| average | 39.6 | 0.97 | 0.77 | 0.96 | 0.29 |

TABLE 2

| number of times of analysis | weight (kg) | moisture (wt %) | dry weight (kg) | HWS (wt %) | nicotine (wt %) | total sugar (wt %) | NO3 (wt %) | Cl (wt %) |
|---|---|---|---|---|---|---|---|---|
| 1 | 69.0 | 28.06 | 49.6 | 8.1 | 0.05 | 0.4 | 0.02 | 0.06 |
| 2 | 26.7 | 9.18 | 24.2 | 9.0 | 0.06 | 0.2 | 0.02 | 0.06 |
| 3 | 26.7 | 8.17 | 24.5 | 8.3 | 0.06 | 0.2 | 0.02 | 0.05 |
| 4 | 30.0 | 4.735 | 28.6 | 9.7 | 0.06 | 0.2 | 0.02 | 0.06 |
| 5 | 33.9 | 4.95 | 32.2 | 8.5 | 0.06 | 0.2 | 0.02 | 0.05 |
| average | | | | 8.72 | 0.06 | 0.22 | 0.02 | 0.06 |

TABLE 3

| | HWS (%) | nicotine (%) | total sugar (%) | NO3 (%) | Cl (%) |
|---|---|---|---|---|---|
| decrease ratio | 78.0 | 94.0 | 71.3 | 97.7 | 80.7 |

Referring to Tables 1 through 3, in the cigar leaf powder, a hot water soluble (HWS) occupies an average of about 39.6 wt %, and nicotine occupies an average of about 0.97 wt %. Therefore, when the cigar leaf powder is directly used in a process of manufacturing the wrapper, biological wastewater treatment is substantially unavailable. Here, the biological wastewater treatment is an operation of continuously culturing a mixed group of microorganisms under the existence of dissolved oxygen by using various organisms included in wastewater as a medium, and removing the organisms by actions such as condensation, absorption, oxidation, degradation, and precipitation. Active sludge, which is a culture body including a mixed group of heterogeneous solid group microorganisms such as bacteriomycota, protozoa, and metazoa, may be used for the biological wastewater treatment. On the other hand, in the reconstituted tobacco sheet, HWS occupies an average of 8.72 wt % and nicotine occupies an average of 0.06 wt %. When the reconstituted tobacco sheet is manufactured, compared to the cigar leaf powder, HWS decreases by 78.0%, and nicotine decreases by 94.0%. Therefore, by manufacturing the wrapper after manufacturing the reconstituted tobacco sheet according to the manufacturing method of the present embodiment, the biological wastewater treatment may be performed on pollutants in a process of manufacturing the wrapper. In operation S22, the wrapper is manufactured by mixing the reconstituted tobacco sheet and the second pulp.

In an embodiment, a drafting paper process may be used to manufacture the wrapper.

The second pulp may include at least any one of the BKP and UKP.

For example, the wrapper may be manufactured by mixing the reconstituted tobacco sheet and the BKP. When the reconstituted tobacco sheet includes the tobacco material and the UKP in a weight ratio of 90:10 and the reconstituted tobacco sheet and the BKP are mixed in a ratio of 25:75, a wrapper including 22.5% of the tobacco material, 2.5% of the UKP, and 75% of the BKP may be manufactured.

Figure 3:
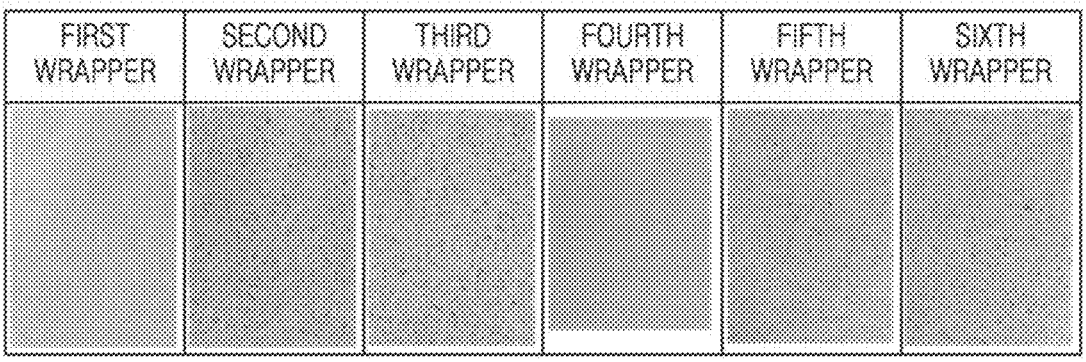
FIG. 3 shows wrappers manufactured by a manufacturing method according to an embodiment.

FIG. 3 shows wrappers manufactured in a manufacturing method according to an embodiment.

The wrappers shown in FIG. 3 are wrappers manufactured by mixing the reconstituted tobacco sheet and the second pulp in different ratios. In detail, a first wrapper was manufactured by mixing the reconstituted tobacco sheet and the BKP in a ratio of 0:100; a second wrapper was manufactured by mixing the reconstituted tobacco sheet and the BKP in a ratio of 20:80; a third wrapper was manufactured by mixing the reconstituted tobacco sheet and the BKP in a ratio of 30:70; a fourth wrapper was manufactured by mixing the reconstituted tobacco sheet and the UKP in a ratio of 0:100; a fifth wrapper was manufactured by mixing the reconstituted tobacco sheet and the UKP in a ratio of 20:80; and a sixth wrapper was manufactured by mixing the reconstituted tobacco sheet and the UKP in a ratio of 30:70.

The fourth through sixth wrappers have colors different from those of the first through third wrappers due to UKP. The first through third wrappers respectively have different patterns due to mixing ratios of the reconstituted tobacco sheets. Also, the fourth through sixth wrappers respectively have different patterns due to mixing ratios of the reconstituted tobacco sheets.

According to FIG. 3, it may be seen that wrappers having various colors and patterns may be manufactured according to the mixing ratios of the reconstituted tobacco sheet and the second pulp. When the UKP is used as the second pulp, brownish wrappers may be manufactured, and as a ratio of the reconstituted tobacco sheet increases, a pattern due to the reconstituted tobacco sheet becomes finer. Accordingly, a weight ratio between the tobacco material and the second pulp may be set in consideration of the color, the pattern, and the like of the finally produced wrapper.

Table 4 is a table indicating physical properties of the wrappers shown in FIG. 3.

TABLE 4

| classification | unit | first wrapper | second wrapper | third wrapper | fourth wrapper | fifth wrapper | sixth wrapper |
|---|---|---|---|---|---|---|---|
| beating time | min | 10 | 9 | 7 | 14 | 11 | 10 |
| CSF | ml | 580 | 580 | 580 | 590 | 580 | 590 |
| Beating degree | SR | 21.0 | 21.0 | 21.0 | 20.5 | 21.0 | 20.5 |
| weight | g/m2 | 40.3 | 40.4 | 40.6 | 40.5 | 40.5 | 40.6 |
| Thickness | μm | 72.8 | 97.3 | 101.4 | 73.6 | 94.3 | 96.9 |
| Density | g/cm3 | 0.55 | 0.42 | 0.40 | 0.55 | 0.43 | 0.42 |
| Bulk | cm3/g | 1.81 | 2.41 | 2.50 | 1.82 | 2.33 | 2.39 |

From Table 4, it may be seen that the physical properties of the wrappers may be adjusted by adjusting the mixing ratios between the reconstituted tobacco sheet and the second pulp. Accordingly, the weight ratio between the tobacco material and the second pulp may be set in consideration of the physical properties of the finally produced wrapper.

Figure 4:
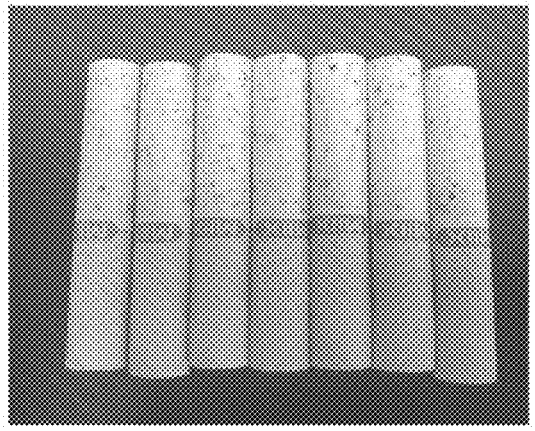
FIG. 4 shows a cigarette wrapped with wrappers manufactured by a manufacturing method according to an embodiment.

FIG. 4 shows cigarettes packaged by wrappers manufactured in a manufacturing method according to an embodiment. FIG. 4 shows cigarettes packaged by wrappers having patterns. By packaging the cigarette by the wrapper manufactured in a manufacturing method according to the present embodiment, it is possible to provide a cigarette with visual distinctiveness compared to the existing cigarettes used in aerosol generating devices.

Table 5 shows physical properties of the wrappers according to an embodiment.

TABLE 5

| classification | unit | | uncoated wrapper | coated wrapper |
|---|---|---|---|---|
| weight | g/m2 | | 50.5 | 50.2 |
| Thickness | μm | | 79.8 | 76.2 |
| Density | g/cm3 | | 0.63 | 0.66 |
| Bulk | cm3/g | | 1.58 | 1.52 |
| Tensile st. | kgf/15 mm | MD | 3.45 | 4.11 |
| | | CD | 1.92 | 2.17 |
| Tensile Index | Nm/g | MD | 44.63 | 53.49 |
| | | CD | 24.84 | 28.24 |
| Elongation | % | MD | 1.94 | 1.53 |
| | | CD | 2.68 | 3.51 |
| Wet Tensile st. | kgf/15 mm | | 1.02 | 1.04 |
| Size Degree | sec | | 0 | 0 |
| Porosity | sec | | 47 | 40 |
| Smoothness | SS | | 56 | 34 |
| | RS | | 2 | 10 |
| Stiffness | cm3 | | 34.4 | 39.4 |

Table 5 shows differences in physical properties between the following: an uncoated wrapper that is manufactured by mixing a reconstituted tobacco sheet and the BKP in a weight ratio of 25:75, wherein the reconstituted tobacco sheet includes the tobacco material and the UKP in a weight ratio of 90:10; and a coated wrapper that is manufactured by coating the uncoated wrapper with 2 wt % of polyvinyl acetate (PVA). Referring to Table 5, a tensile strength of the uncoated wrapper is 3.45 kgf/15 mm in a machine direction (MD) and 1.92 kgf/15 mm in a cross direction (CD). A tensile strength of the coated wrapper is 4.11 kgf/15 mm in MD and 2.17 kgf/15 mm in CD. Therefore, it may be seen that a wrapper having a tensile strength of 3.0 kgf/15 mm or greater may be manufactured. As the tensile strength of the wrapper is 3.0 kgf/15 mm or greater, breaking of the wrapper during a manufacturing process of the wrapper may be prevented. Therefore, splicing (a connection process in automatic replacement of the wrapper) may be used in processes of manufacturing a coated wrapper and an uncoated wrapper. Furthermore, as a tensile strength of the coated wrapper is 4.0 kgf/15 mm or greater, splicing may be smoothly performed. Although Table 5 shows that PVA used as a coating material, in other embodiments, other coating materials such as gum and starch may be used. In addition, although 2 wt % of PVA is used as a coating material in Table 5, the weight of PVA may be different in other embodiments.

Table 6 shows a result of thermal degradation analysis obtained from samples.

TABLE 6

| samples | analysis conditions | detected components |
|---|---|---|
| coated wrapper | thermal degradation for 270 seconds respectively under 150/200/250° C. | no components detected under the analysis conditions |
| uncoated wrapper | thermal degradation for 270 seconds respectively under 150/200/250° C. | no components detected under the analysis conditions |
| PVA | thermal degradation for 270 seconds respectively under 150/200/250° C. | no components detected under the analysis conditions |

The samples include: an uncoated wrapper generated by mixing the reconstituted tobacco sheet and the BKP in a weight ratio of 25:75, wherein the reconstituted tobacco sheet includes the tobacco material and the UKP in a weight ratio of 90:10; a coated wrapper that is manufactured by coating the uncoated wrapper with 2 wt % of PVA; and PVA. Referring to Table 6, it may be seen, as no component is detected from the samples, it is safe to use a cigarette packaged by a PVA-coated wrapper in the aerosol generating device. Table 7 shows an analysis result of smoke components obtained from the samples.

TABLE 7

| samples | unit | TPM | Tar | Nicotine | PG | Gly | moisture |
|---|---|---|---|---|---|---|---|
| existing | mg/stick | 51.5 | 21.6 | 0.80 | 0.72 | 3.41 | 29.2 |
| wrapper | CV (%) | 3.1 | 4.5 | 5.1 | 7.8 | 5.9 | 4.5 |
| uncoated | mg/stick | 51.1 | 21.7 | 0.79 | 0.74 | 3.40 | 28.6 |
| wrapper | CV (%) | 2.3 | 5.2 | 4.4 | 7.2 | 6.7 | 4.7 |

TABLE 7-continued

| samples | unit | TPM | Tar | Nicotine | PG | Gly | moisture |
|---|---|---|---|---|---|---|---|
| coated | mg/stick | 52.1 | 21.4 | 0.82 | 0.71 | 3.52 | 29.9 |
| wrapper | CV (%) | 4.3 | 9.9 | 7.5 | 9.9 | 6.5 | 4.6 |

The samples include: a cigarette packaged by an existing wrapper that is manufactured in an existing method; a cigarette packaged by an uncoated wrapper that is formed by mixing the reconstituted tobacco sheet and the BKP in a ratio of 25:75, wherein the reconstituted tobacco sheet includes the tobacco material and the UKP in a weight ratio of 90:10; and a cigarette packaged by the coated wrapper that is manufactured by coating the uncoated wrapper with 2 wt % of PVA. Referring to Table 7, smoke components of the cigarette packaged by the uncoated wrapper and the cigarette packaged by the coated wrapper are similar to the smoke components of the cigarette packaged by the existing wrapper. Accordingly, it may be seen that smoke components at a level that is the same as the cigarette packaged by the existing wrapper may be obtained from the cigarette packaged by the wrapper that is manufactured in the manufacturing method according to the present embodiment. Table 8 shows a result of sensory evaluation on the samples.

TABLE 8

| | existing wrapper | uncoated wrapper | coated wrapper |
|---|---|---|---|
| atomization amount | 3.73 | 3.70 | 3.88 |
| durability of atomization amount | 4.17 | 4.38 | 4.32 |
| suction performance | 3.70 | 3.69 | 3.75 |
| sense of heat of mainstream smoke | 3.59 | 3.56 | 3.52 |
| sense of heat of cigarette surface | 3.73 | 3.65 | 3.66 |
| smoking intensity | 3.93 | 4.00 | 4.00 |
| irritation | 3.72 | 3.78 | 3.81 |
| off flavor | 3.51 | 3.37 | 3.48 |
| whole taste of tobacco | 3.78 | 4.10 | 4.12 |

The samples include: a cigarette packaged by an existing wrapper that is manufactured in an existing method; a cigarette packaged by an uncoated wrapper that is formed by mixing the reconstituted tobacco sheet and the BKP in a ratio of 25:75, wherein the reconstituted tobacco sheet includes the tobacco material and the UKP in a weight ratio of 90:10; and a cigarette packaged by the coated wrapper that is manufactured by coating the uncoated wrapper with 2 wt % of PVA. The sensory evaluation was performed on twenty general users regarding nine options, with reference to a full score of seven points each. The nine options include an atomization amount, durability of the atomization amount, suction performance, sense of heat of mainstream smoke, sense of heat of cigarette surface, smoking intensity, irritation, off flavor, and whole taste of tobacco. Referring to Table 8, compared to the cigarette packaged by the existing wrapper, the cigarette packaged by the uncoated wrapper and the cigarette packaged by the coated wrapper have equal or higher evaluation scores. Particularly, in options of the durability of atomization amount and the whole tobacco taste, the cigarette packaged by the uncoated wrapper and the cigarette packaged by the coated wrapper have evaluation scores higher than that of the cigarette packaged by the existing wrapper. Accordingly, it may be found that the cigarette packaged by the wrapper manufactured in the manufacturing method according to the present embodiment has the quality that is equal to or higher than that of the cigarette packaged by the existing wrapper.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. A method of manufacturing a wrapper for a non-combustion-type cigarette used in an aerosol generating device, the method comprising:

manufacturing a reconstituted tobacco sheet by mixing a tobacco material and first pulp;

manufacturing an uncoated wrapper by mixing the reconstituted tobacco sheet and second pulp which is at least one of unbleached kraft pulp and bleached kraft pulp; and manufacturing a coated wrapper by coating the uncoated wrapper with a coating material of at least one of polyvinyl acetate (PVA), gum, and starch.

2. The method of claim 1, wherein the manufacturing of the reconstituted tobacco sheet comprises manufacturing the reconstituted tobacco sheet by mixing the first pulp and at least one of cigar leaf powder, cigar leaf pieces, cigar leaves, and tobacco leaves, as the tobacco material.

3. The method of claim 1, wherein the manufacturing of the reconstituted tobacco sheet comprises manufacturing the reconstituted tobacco sheet by mixing the tobacco material and at least one of unbleached kraft pulp and bleached kraft pulp as the first pulp.

* * * * *